US005413285A

United States Patent [19]

Matthews et al.

[11] Patent Number: 5,413,285

[45] Date of Patent: May 9, 1995

[54] METHOD OF TREATING ADHERENT SEMICONDUCTOR PARTICLES TO BREAK THEM APART

[75] Inventors: Mark D. Matthews, Richardson; Johnny Langley, Dallas, both of Tex.

[73] Assignee: Texas Instruments Incorporated, Dallas, Tex.

[21] Appl. No.: 180,583

[22] Filed: Jan. 12, 1994

[51] Int. Cl.[6] ..... B02C 19/06

[52] U.S. Cl. ..... 241/5; 241/18

[58] Field of Search ..... 241/5, 14, 18, 24, 29, 241/39, 40, DIG. 10

[56] References Cited

U.S. PATENT DOCUMENTS

| | | | |
|---|---|---|---|
| 2,768,938 | 10/1956 | Martin | 241/40 X |
| 3,208,950 | 9/1965 | Yocom et al. | 241/14 X |
| 3,853,274 | 12/1974 | Wright et al. | 241/40 |
| 4,323,198 | 4/1982 | Turner et al. | 241/40 X |
| 4,354,641 | 10/1982 | Smith | 241/40 |
| 4,691,866 | 9/1987 | Belk | 241/40 X |
| 5,012,619 | 5/1991 | Knepprath et al. | 241/39 X |
| 5,069,740 | 12/1991 | Levine et al. | 423/348 X |

FOREIGN PATENT DOCUMENTS

| | | | |
|---|---|---|---|
| 1094977 | 5/1955 | France | 241/40 |

*Primary Examiner*—Timothy V. Eley
*Attorney, Agent, or Firm*—John D. Kaufmann; James C. Kesterson; Richard L. Donaldson

[57] ABSTRACT

Adherent silicon spheres (10) are broken apart into separate spheres by entraining them in a high velocity gas stream (12) which is directed at a surface (20). When the adherent spheres (10) impact on the surface (20) they break apart. The gas (12) and the separated spheres (10) are directed away from the surface (20) along divergent paths and the spheres (10) are collected for use.

15 Claims, 1 Drawing Sheet

METHOD OF TREATING ADHERENT SEMICONDUCTOR PARTICLES TO BREAK THEM APART

BACKGROUND OF THE INVENTION

The present invention relates to a method of treating particles, and, more particularly, to a method of treating spherical or spheroidal semiconductor particles, after they have been subjected to melting or heating, so as to separate adjacent particles which adhere or stick together because of the prior melting or heating. In specific embodiments, the particles are silicon spheres or spheroids which are used to fabricate solar cells.

One type of solar cell or photovoltaic device includes a plurality of spherical or spheroidal semiconductor particles which extend away from both sides of a first flexible metal foil sheet and are affixed to the walls of apertures formed in the foil sheet. The details of the construction (i.e., the mechanical and electrical form, fit and function) and fabrication methodology of this type of solar cell may be found in the following commonly assigned U.S. Pat. Nos.: 5,192,400; 5,091,319; 5,086,003; 5,028,546; 4,994,878; 4,992,138; 4,957,601; 4,917,752; 4,872,607; 4,806,495; and 4,691,076.

The aforenoted fabrication methodology utilizes generally unisized spheres of a semiconductor material, such as silicon, each having a p-n junction, which spheres are produced by one of a number of techniques. See, for example the production methods disclosed in commonly assigned U.S. Pat. Nos. 4,430,150; 4,637,855; 5,012,619; and 5,069,740. The spheres are typically constituted of an outer silicon portion or shell of one conductivity type surrounding an inner silicon portion of the other conductivity type, both portions having a selected purity and other relevant characteristics. The spheres are capable of producing electricity when radiation, such as solar radiation, is incident thereon. The produced electricity may flow between conductors, one of which is electrically continuous with the outer portion of each sphere, and the other of which is electrically continuous with the inner portion of each sphere. In the aforenoted patents, these conductors are preferably flexible foils of a metal such as aluminum, to the first of which the outer portions of the spheres are affixed, as noted above.

A contemplated method for manufacturing solar cells begins with forming in the first aluminum or other metal foil sheet a pattern of apertures, the diameters of which are slightly less than the diameters of an available quantity of same-sized silicon or other semiconductor spheres. One method for forming the apertures includes first embossing and then etching the foil sheet. After formation of the aperture pattern, the spheres are loaded onto the foil so that each aperture is overlain by a sphere. Because of the relative sizes of the diameters of the same-sized spheres and the apertures, the aperture-located spheres merely nest in their respective apertures on one side of the foil sheet without substantially protruding through the other side of the foil sheet.

The spheres are then mechanically and electrically affixed and connected to the first foil. Such affixation and connection is achieved by applying suitable compressive forces to the foil-sphere system, as set forth in the above-noted patents. Typically the application of the compressive forces is achieved by the use of a press which acts on the spheres and the foil through selected compliant and rigid elements which are positioned between working surfaces of the press and the foil-sphere system. These elements prevent damage to the spheres and to the foil, while ensuring that the applied forces effectively move the spheres partially through their respective apertures.

Partial movement of the spheres through their respective apertures effects mechanical affixation of the spheres to the walls of their apertures and renders electrically continuous with the first foil the outer surfaces of the spheres. These ends are achieved, in part, through the relationship of the larger diameters of the spheres to the smaller diameters of the apertures. This relationship directly results in the mechanical and electrical affixation and aids in effecting the electrical continuity of the spheres with the first foil. When the spheres are moved partially through the apertures, the edges of the aperture walls and the surface of the spheres mechanically interact and mutually abrade each other to remove any natural oxide on the spheres or the aperture walls. Thus, a metal-sphere (i.e., an aluminum-silicon) bond is formed. The foregoing may be enhanced by the application of heat during the compression.

The outer portion of one conductivity type of the located and affixed spheres is removed, as by etching, from the spheres. This removal occurs only on one side of the first foil sheet to expose the inner sphere portions of the opposite conductivity type. An electrically insulative layer is applied or deposited on the exposed inner sphere portions and the one foil sheet side. Small regions of the layer which overlie the exposed inner sphere portions are removed, as by abrading or etching, to create openings or vias through which access to the inner sphere portions may be obtained. A second flexible metal (e.g., aluminum) foil is mechanically and electrically connected to the inner portions of the spheres through the openings or vias by thermo-compression bonding or a functionally equivalent technique.

The solar cell is now nearly complete. Radiant energy directed toward the free surface of the first foil falls on the spheres which produce electricity. A utilization device is connected between the foils. The electricity flows from one portion, inner or outer, of the spheres through one of the foils, through the utilization device and ultimately through the other foil into the other portion, outer or inner, of the spheres. The insulative layer electrically insulates the foils from each other. The flexible cell may be conformed to a desired surface or shaped in selected fashion. A protective cover may be placed over or applied to the spheres. The cover may include or comprise lenses Which direct an increased amount of incident radiant energy onto the spheres to increase the efficiency of the cell.

Typical silicon sphere production techniques may result in batches of intermingled silicon spheres or spheroids which are adherent or stuck together. Specifically, the production of silicon spheres usable in the solar cells of the foregoing patents is exemplified in commonly assigned U.S. Pat. Nos. 4,430,150; 4,637,855; and 5,069,740. Silicon sphere production involves the heating and melting, often repetitive, of particulate metallurgical grade silicon starting material or feed stock. Melting of the silicon is preceded by the formation about each silicon particle of a skin of a material such as silicon dioxide. Melting of the metallurgical grade silicon particles results in impurities therein traveling to the previously formed skin and in each particle of the melted silicon being configured by surface tension into a sphere or spheroid. The skin is sufficiently plastic to permit the assumption of this configuration without rupturing. The skin-encased silicon spheres or spheroids are then controllably cooled until they resolidify. Subsequently, the skins are removed from the resolidified silicon spheres, which have a higher purity than metallurgical grade silicon. Repetitive effectuation of the process results in semiconductor grade silicon spheres.

Due to their proximity while they are molten, adjacent spheres or spheroids may, at times, adhere together after resolidification. Since the spheres are intended to be used individually in fabricating solar cells, or are intended to be individually further processed before such use, an object of the present invention is the provision of a method of and apparatus for treating the spheres or spheroids by breaking apart adherent ones thereof.

SUMMARY OF THE INVENTION

With the above and other objects in view, the present invention contemplates a method of breaking apart two or more adherent, solidified particles. The particles adhere to each other because they were abutting when they were molten, and while so abutting they were solidified. Typically, the particles are spherical or spheroidal. The particles may include a semiconductor material such as silicon and may be destined for inclusion in a solar cell of the type set forth in the eleven patents cited in the second paragraph of the foregoing "Background."

In its broadest aspect, the method includes entraining the adherent particles in a high velocity stream of gas. The gas stream and the entrained particles are directed at a surface. When the particles impact against the surface they are broken apart. The surface preferably does not contaminate the particles when they impact thereagainst. Also, the surface has a hardness which does not result in mechanical damage to the broken apart particles. The surface may include or be covered with a low surface energy material such a polytetrafluorethylene, which meets the foregoing contamination and hardness criteria.

In another aspect of the present method, which permits large numbers of particles to be broken apart at a high rate, both non-adherent and adherent particles are entrained in the gas stream, and the method is thereafter carried out as set forth above to break apart the adherent particles.

The method may also include diverting the gas stream away from the surface while preventing the broken apart and the originally non-adherent particles from following the diverted gas. The particles, both broken apart and originally non-adherent, are directed to a collection region.

The broken apart particles may have surface irregularities at the locations of their adherence to other particles. Some end uses of the particles may require that the particles be spherical with few if any surface irregularities. Thus, in another aspect, the present invention contemplates a method of rendering the broken apart particles spherical in shape. This is achieved by remelting and then resolidifying the broken apart particles to permit surface tension to eliminate the surface irregularities.

In yet another aspect, the present invention contemplates a method of forming individual, separated particles of relatively higher purity semiconductor material from particles of relatively lower purity semiconductor material. The particles are typically silicon spheres or spheroids used to fabricate solar cells.

Initially, the lower purity particles may be treated in general accordance with previously cited U.S. Pat. Nos. 4,430,150 or 5,069,740. Specifically, the lower purity particles are treated in a reactive atmosphere to form thereon a skin of a dissimilar material, such as an oxide of the particle material. Next the skin-contained material is melted and then resolidified, which causes impurities to travel to and become captured in the skin. The melting and resolidification of the particles tends to cause abutting particles to adhere. Accordingly, the adherent particles are broken apart according to the method in its broadest aspect, as set forth above. The skin, and the impurities trapped therein, are then removed from the broken apart particles. As taught by the '150 and '740 patents iteration of the skin-forming, melting, resolidifying, and skin-removing steps may further increase the purity of the particles. Accordingly, the present invention contemplates iteration of both these steps and the steps related to breaking apart the particles.

DETAILED DESCRIPTION

Figure 2:
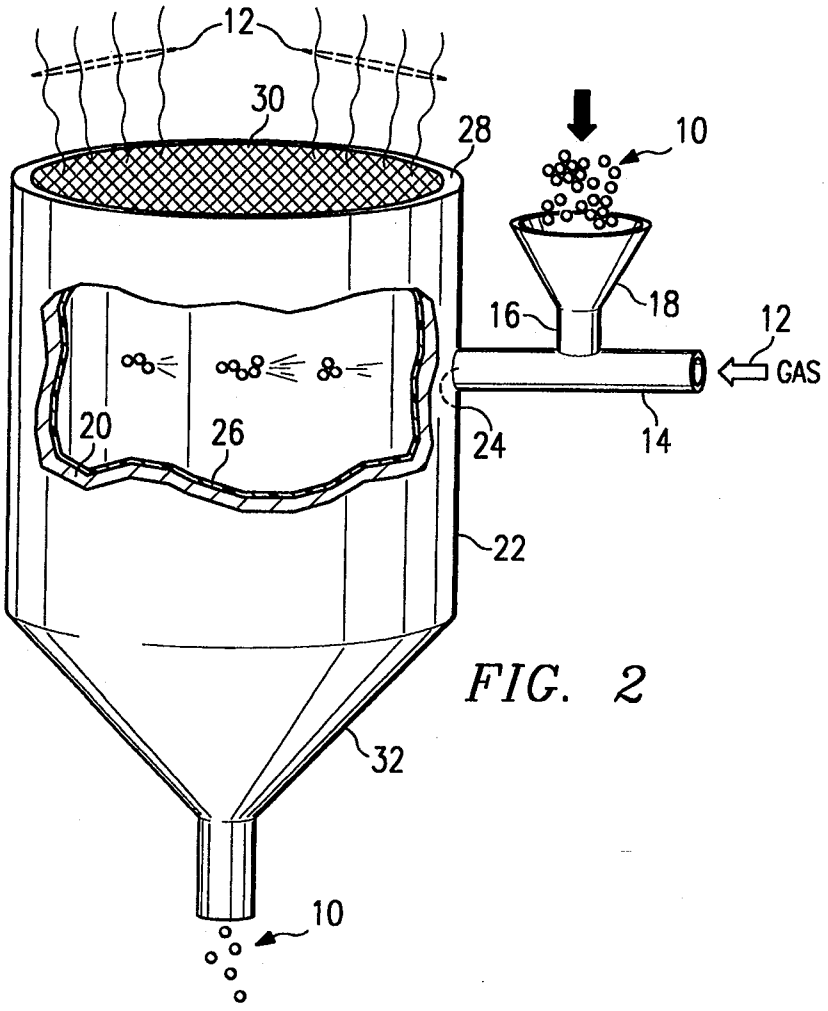
FIG. 2 is a generalized depiction of apparatus for effecting the method of the present invention.
Figure 1:
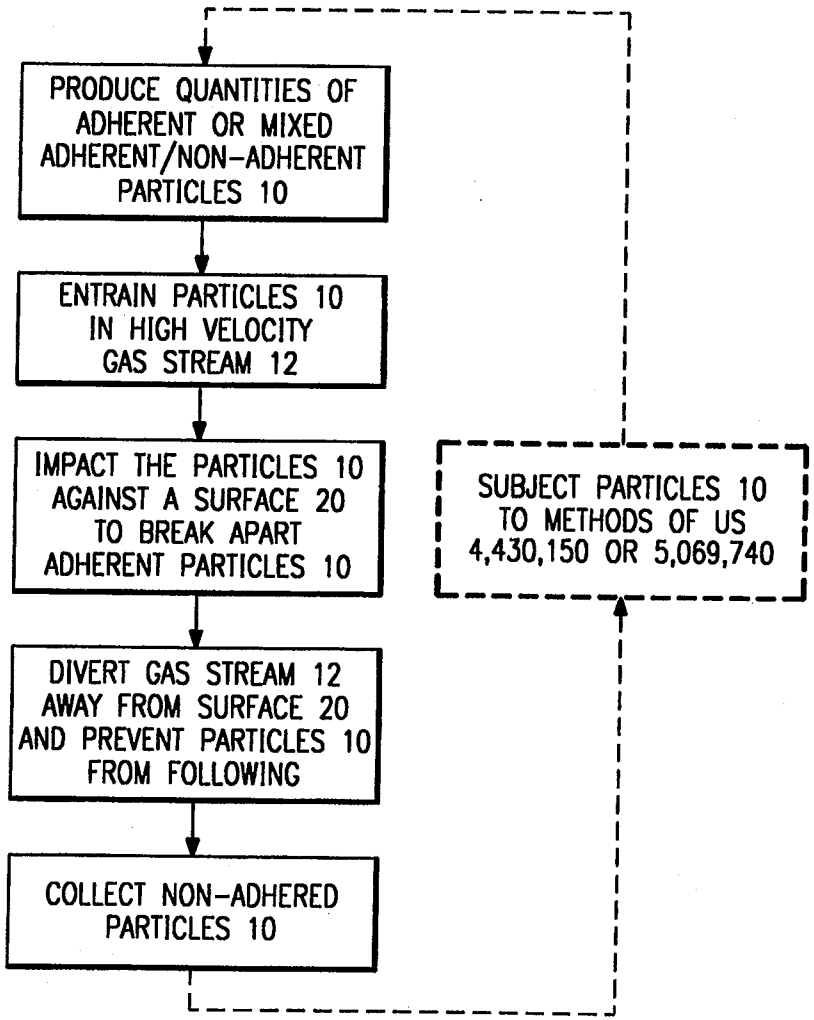
FIG. 1 is a flow chart of the various steps of the process according to the present invention.

Referring to FIGS. 1 and 2, there will be described a method of breaking apart two or more adherent, solid particles 10. The particles 10 became adherent to each other because they were abutting when they were molten and then solidified. The adherency of the particles 10 may result from the practice of the inventions set forth in the aforenoted, especially U.S. Pat. Nos. 4,430,150 and 5,069,740.

According to the foregoing patents, particulate, metallurgical grade, impurity-containing silicon is upgraded to higher purity silicon suitable for inclusion in a solar cell by forming a skin on solid silicon particles 10 in a reactive atmosphere, melting the skin-contained silicon, and controllably cooling and resolidifying the skin-contained silicon. Impurities in the silicon migrate to and are trapped in the skin. The silicon particles 10 resolidify as spheres or spheroids. The skin and its trapped impurities are removed. The purification process may be iterated to increase the purity of the silicon particles 10.

It has been found that, as a result of the melting and resolidification involved in the purification process, the resulting purified silicon particles 10 may adhere to each other. Since it is intended for same-sized, individual, spherical particles 10 to be used to fabricate solar cells of the type described earlier, it is necessary to break apart adherent particles 10, and this is a goal of the present invention. Of course, those skilled in the art will appreciate that the method hereof is applicable to other particulate work pieces.

The first step of the instant method is the entrainment of the adherent particles 10 in a high velocity gas stream 12. The velocity of the gas 12 is sufficiently high to permit the frictional effects of the gas 12 on the particles 10 to exceed and overcome gravitational effects thereon, with the result that the particles 10 move with, and as a part of, the gas stream 12.

If it is convenient to first separate adherent particles 10 from non-adherent particles 10, only the adherent particles need be entrained in the gas stream 12. Silicon particles 10 used in fabricating solar cells are quite small, and such pre-sorting is time-consuming and costly. Indeed, the present method may be utilized to eliminate the need for pre-sorting by permitting quantities of both adherent and non-adherent particles 10 to be entrained in the gas stream 12.

Entrainment may be achieved by flowing air at 70 to 100 psi through a pipe or conduit 14 and feeding the particles 10 into the air stream 12 via an inlet 16 communicating with the interior of the pipe 14. The inlet 16 may terminate in a funnel 18 or other convenient configuration which facilitates the addition thereinto of the particles 10. The gas 12 may be selected to affect or not affect the particles 10 in desired ways. It is desired that the gas 12 not contaminate nor otherwise affect the particles 10. Air has found to have no deleterious effect on the silicon particles 10 at standard pressure and temperature, although other gases may be used.

The gas stream 12 and the particles 10 entrained therein move at high velocity toward a surface 20, against which the particles are impacted. The force of the impact is sufficiently high to break adherent particles 10 apart. In the Figures, the surface 20 constitutes a portion of the interior of a cylindrical chamber 22. The surface 20 is diametrically opposite an entry passage 24 formed through the chamber 22 with which the pipe 14 is continuous. The particles 10 entrained in the gas 12 move through the pipe 14 and out of the entry 24, following which they move at high velocity across the interior of the chamber 22 before impacting against the surface 20.

The surface 20 may be coated or covered with a layer 26 of a material which is inert with respect to the particles 10 so that the impact effects no contamination thereof. The layer 26 may also serve to somewhat cushion the particles 10 at the instant of impact to prevent mechanical damage—abrasion, cracking, or the like—to the particles 10. Low surface energy material sold under the trademark "Teflon", generically polytetrafluoroethylene, has been found acceptable as the material for the layer 26.

After the particles 10 have impacted against the surface 20 and adherent ones thereof have been broken apart, the gas 12 is diverted away from the surface 20, while the particles 10 within the chamber 22 are prevented from following the gas 12. The foregoing ends may be achieved by configuring the chamber 22 to have an open top 28 which is covered with a screen or mesh 30 which will not permit the passage of the particles 10 therethrough. As the air 12 and the entrained particles 10 impact on the surface 20, the air 12 is deflected by the surface 20 radially away from the point of impact. The velocity of the deflected air 12 is substantially lower than it was just before impact and further decreases as it moves away from the point of impact. The screen 30 permits the deflected, lower velocity air 12 to escape from the chamber 22, while preventing any particles 10, including those which become entrained therein, from escaping.

Because of the lower velocity of the air 12 at locations remote from the point of impact on the surface, any effects thereof on the particles 10 are dominated by gravitational effects. Thus, following the impact of the particles 10 against the surface 20, the particles 10 tend to fall downwardly toward the lower regions of the chamber 22, where the particles 10 may be collected. To that end, the bottom of the chamber 22 may be configured as a funnel 32 or the like which acts as a collection region or which directs the particles 10 to a collection region.

Typical silicon spheres or spheroids 10 of the type used in solar cells have diameters in the range of 25–45 mil. The practice of the above method has been found to permit the processing of batches of such particles 10 at a rate of 1 kg/min, the batches including adherent and non-adherent particles 10 commingled together.

Formerly adherent particles 10 which have been broken apart have been found to have surface irregularities at the locations of their former adherence to other particles 10. If, as in the case of silicon particles 10 destined for inclusion in solar cells, such surface roughness is undesirable, the particles 10 may be remelted and resolidified to again permit surface tension to impart sphericality to the particles 10. As noted above, silicon sphere purification as practiced by the foregoing patents may, in any event, involve iterative melting and resolidification.

What is claimed is:

1. A method of breaking apart two or more adherent, solid particles, the particles having become adherent by abutting when they were molten and then being solidified, the method comprising:

entraining the adherent particles in a high velocity stream of gas and directing the gas stream and the entrained particles at, and impacting the particles against, a surface, so that the impact breaks the particles apart.

2. A method as in claim 1, wherein:

the particles are spheres or spheroids.

3. A method as in claim 2, wherein:

the particles contain a semiconductor.

4. A method as in claim 3, wherein:

the semiconductor is silicon.

5. A method as in claim 1, wherein:

the surface does not contaminate the particles.

6. A method as in claim 1, wherein:

the surface has a hardness which does not result in mechanical damage to the broken apart particles.

7. A method as in claim 6, wherein:

the surface is a low surface energy material.

8. A method as in claim 7, wherein:

the surface is polytetrafluouroethylene.

9. A method as in claim 1, which further comprises:

diverting the gas stream away from the surface while preventing the broken apart particles from following the diverted gas, and directing the broken apart particles to a collection region.

10. A method of producing spherical or spheroidal particles by the method of claim 1, wherein broken apart particles may have surface irregularities at the locations of their previous adherence to other particles, which further comprises:

remelting and then resolidifying the broken apart particles to permit surface tension to eliminate the surface irregularities.

11. A method of forming individual, separated particles of relatively higher purity semiconductor material from particles of relatively lower purity semiconductor material, which comprises:

(a) treating the lower purity particles in a reactive environment to form thereon a skin;

(b) first melting and then resolidifying the skin-contained material so that impurities therein travel to and are captured in the skin, the melting and resolidifying tending to effect adherence between abutting particles; and (c) entraining the resolidified adherent particles in a high velocity stream of gas and directing the gas stream and the entrained particles at, and impacting the particles against, a surface, so that the impact breaks the particles apart.

12. A method as in claim 11, which further comprises:

(d) removing the skin from the resolidified, broken apart, higher purity particles.

13. A method as in claim 12, wherein:

steps (a) through (d) are iterated at least once.

14. A method as in claim 11, wherein:

the semiconductor material is silicon, and the resolidified particles are spherical or spheroidal.

15. A method of treating solid particles, some of which adhere to one or more other particles because they abutted when they were molten and then solidified, the method comprising:

entraining the particles in a high velocity stream of gas and directing the gas stream and the entrained particles at, and impacting the particles against, a surface so that the impact breaks apart the adherent particles.

* * * * *